US005653339A

United States Patent [19]

Dobson

[11] Patent Number: 5,653,339

[45] Date of Patent: Aug. 5, 1997

[54] STORAGE RECEPTACLE FOR CHRISTMAS LIGHTS AND ACCESSORIES

[76] Inventor: Alicia A. Dobson, 3311 Lupine Dr., Indianapolis, Ind. 46224

[21] Appl. No.: 503,912

[22] Filed: Jul. 19, 1995

[51] Int. Cl.[6] ..... B65D 85/42

[52] U.S. Cl. ..... 206/420; 206/419; 206/702; 206/408

[58] Field of Search ..... 206/419, 420, 206/422, 408, 702; 220/529, 532, 533

[56] References Cited

U.S. PATENT DOCUMENTS

| | | | |
|---|---|---|---|
| 2,872,032 | 2/1959 | West | 206/419 |
| 3,984,023 | 10/1976 | Hodas | 220/532 |
| 4,410,084 | 10/1983 | Ladner | 206/408 |
| 4,793,508 | 12/1988 | Thompson | 220/533 |
| 5,033,619 | 7/1991 | Garis | 206/419 |
| 5,064,067 | 11/1991 | McAllister et al. | 206/420 |
| 5,314,070 | 5/1994 | Ciarlei | 206/408 |
| 5,381,899 | 1/1995 | Rabbitt | 206/408 |
| 5,526,931 | 6/1996 | White | 206/419 |

FOREIGN PATENT DOCUMENTS

| | | | |
|---|---|---|---|
| 2083292 | 12/1993 | Canada | 206/419 |
| 52-30597 | 3/1977 | Japan | 206/420 |

*Primary Examiner*—David T. Fidei
*Attorney, Agent, or Firm*—Michael A. Myers

[57] ABSTRACT

A storage receptacle especially useful for containing Christmas lighting and accessories has at least one cordage member for supporting and securing strands of Christmas lights. The cordage member has a handle with opposite terminal ends. Opposing walls of the receptacle have top edges with spaced slots formed therein. The terminal ends of the handle are bent obliquely relative to the longitudinal axis of the cordage member so that the slots can receive the ends when the cordage member is positioned within the receptacle. The cordage member is reversible and interchangeable. The receptacle has a lock for securing a top so that the contents of the receptacle may be safely stowed away.

7 Claims, 4 Drawing Sheets

STORAGE RECEPTACLE FOR CHRISTMAS LIGHTS AND ACCESSORIES

The present invention relates to storage receptacles and more particularly relates to a storage receptacle especially useful for organizing and containing lights, ornaments, and other Christmas decorating paraphernalia.

Christmas decorating paraphernalia, e.g., strands of lighting, tree ornaments, and other delicate aesthetic and sentimental articles, are on display for a very short period of time, the Christmas season, and in storage most of their existence. This presents the decorator or owner lo of these Christmassy articles with numerous problems.

The most obvious problem is how to package and store these items in a neat organized fashion so they are not damaged, especially glass items. The manufacturer's packaging has limited utility beyond its point of sale. The cartons and packaging decorations and lights come in are cheaply manufactured and lack physical strength and substance. Most people discard the packaging after making their purchase; and, those receptacles that are used repeatedly become deformed or wear out. The same is true with the cardboard boxes and bags, which many decorators resort to using for storage. These receptacles were not made for storing strands of Christmas lights or delicate tree ornaments and fail miserably when put to this use.

Also, when every day boxes and bags are used for containing strands of lights and decorations, the owner has difficulty locating a particular item in storage or differentiating between boxes. This is especially inconvenient when the boxes are stored in the far corner of the attic, for example, and the owner does not have time to locate a particular item buried in the bottom of an unidentifiable box.

Additional problems arise when trying to manage and store strands of Christmas lights. Christmas lights are comprised of electrical cordage to which sockets are attached. The sockets house illuminating bulbs, and the bulbs are often formed of glass. When managing strings of lights, care must be taken so that the cordage does not become tangled, the sockets are not damaged, and the bulbs are not broken. The only storage means heretofore available for strands of lights amount to bundling the cordage together and placing it in a box or bag. Clearly, this technique offers little protection to the bulbs and can cause tangles to form in the cordage. Tangles result in kinks, which in turn cause shorts in the electrical circuit. This is unacceptable. Shorts in the electrical circuitry prevent the lights from illuminating. Locating a short within the cordage can be time consuming and frustrating, because, as is the case with some brands of Christmas lights, if there is a defective bulb or socket on the string, this, too, can prevent the strand of lights from illuminating.

In the latter case, replacing the defective socket or bulb corrects the problem, but when the cord is defective, a new one must be purchased. Owners who are unable to distinguish between these types of problems with the cordage may discard an otherwise fine strand of lights. This is wasteful and can become costly for decorating enthusiasts. Also, when handling tangled strands of lights, the likelihood of bulb breakage increases. This is especially the case when decorating with lights outdoors where orienting and placing the lights in uncharacteristic positions is the goal. Lastly, when strands of lights are stored in the same receptacle with tree decorations, for example, the cordage and decorations often become entangled, adding to the decorator's frustration.

Therefore, it is highly desirable to provide an improved storage receptacle for Christmas lights and accessories.

It is also highly desirable to provide an improved storage receptacle which is capable of storing Christmas lights and accessories together in a neat organized fashion for conveniently locating and easily accessing the lighting and the decorations.

It is also highly desirable to provide an improved storage receptacle for Christmas lights and accessories that resists wear and deformation.

It is also highly desirable to provide an improved storage receptacle for Christmas lights and accessories which is capable of supporting and conveniently handling strands of Christmas lights preventing tangles and kinks in the cordage and shorts in the circuitry.

It is also highly desirable to provide an improved storage receptacle for Christmas lights and accessories which is capable of securely holding strands of Christmas lights so that the cordage and decorations do not become entangled, the sockets do not become damaged, and the bulbs do not break.

It is finally highly desirable to provide an improved storage receptacle for Christmas lights and accessories that meets all the above desired features.

SUMMARY

Therefore, it is an object of the invention to provide an improved storage receptacle for Christmas lights and accessories.

It is also an object of the invention to provide an improved storage receptacle which is capable of storing Christmas lights and accessories together in a neat organized fashion for conveniently locating and easily accessing the lighting and the decorations.

It is also an object of the invention to provide an improved storage receptacle for Christmas lights and accessories that resists wear and deformation.

It is also an object of the invention to provide an improved storage receptacle for Christmas lights and accessories which is capable of supporting and conveniently handling strands of Christmas lights preventing tangles and kinks in the cordage and shorts in the circuitry.

It is also an object of the invention to provide an improved storage receptacle for Christmas lights and accessories which is capable of securely holding strands of Christmas lights so that the cordage and decorations do not become entangled, the sockets do not become damaged, and the bulbs do not break.

It is finally an object of the invention to provide an improved storage receptacle for Christmas lights and accessories that meets all the above desired features.

In the broader aspects of the invention there is provided a storage receptacle for Christmas lights and accessories with a bottom, a pair of upstanding side walls, a pair of opposite end walls, and a top. The walls are joined to the bottom to define an interior and an exterior. The side walls have top edges with spaced slots formed therein. There is provided at least one cordage member for supporting and securing strands of Christmas lights. There is also a cordage member housing. The cordage member has a handle member with opposite terminal ends. The terminal ends of the handle member are shaped in order that the slots can receive the terminal ends and the cordage member can be removably secured within the interior of the receptacle in an upstanding position. A pair of downwardly extending strand guides are secured to the handle member between the terminal ends. Each of the strand guides has an outer surface and an inner surface. The outer surfaces face the terminal ends, respectively, and the outer surfaces have notches formed therein for supporting strands of Christmas lights.

There is also provided at least one dividing member. The dividing member has a top, a bottom, and a central dividing body between the top and the bottom. A handle member with terminal ends is fastened to the top of the dividing member. The terminal ends of the handle member are shaped in order that the slots in the top edges of the side walls can receive the terminal ends.

DRAWINGS

The above-mentioned and other features and objects of the invention and the manner of attaining them will become more apparent and the invention better understood by reference to the following description of an embodiment of the invention taken in conjunction with the accompanying drawings and descriptive matter in which there is illustrated preferred embodiments of the invention.

DESCRIPTION

Figure 1:
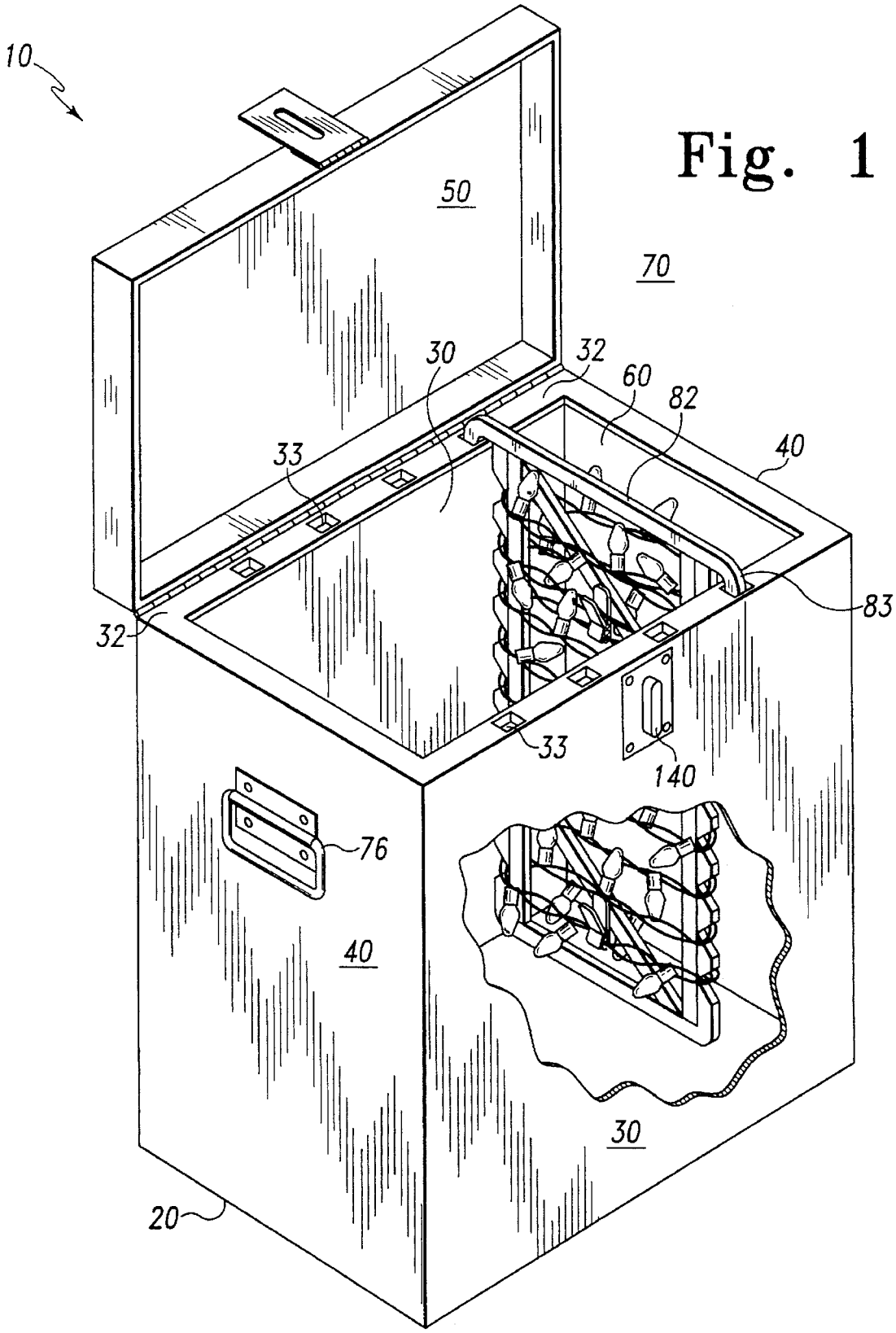
FIG. 1 is a perspective view of the storage receptacle of the invention.

Storage receptacle 10 of the invention has a bottom 20, a pair of upstanding side walls 30, a pair of oppositely disposed end walls 40, and a top 50. Walls 30,40 are joined to bottom 20 to define interior 60 and exterior 70. Walls 30,40, bottom 20, and top 50 are formed of a generally rigid material, such as reinforced cardboard, plastic, or the like, and may be integrally formed. Side walls 30 have top edges 32 with spaced slots 33 formed therein. Slots 33 are formed by conventional means, such as cut outs or a router. In one embodiment, top edges 32 are the respective terminal ends of side walls 30 bent inwardly toward the interior 60 to form a edge 32 generally transverse to Side walls 30, and slots 33 extend entirely through top edges 32. In all embodiments, slots 33 in top edges 32 of one of side walls 30 are generally in alignment with oppositely disposed complementary slots 33 formed in the opposite top edge 32 of the opposite side wall 30, as shown in FIG. 1. Top 50 is hingedly secured to one of side walls 30 and capable of being secured in a closed position by known means, such as lock 140. Handles 76 for carrying storage receptacle 10 are secured to the exterior of side walls 40.

Figure 2A:
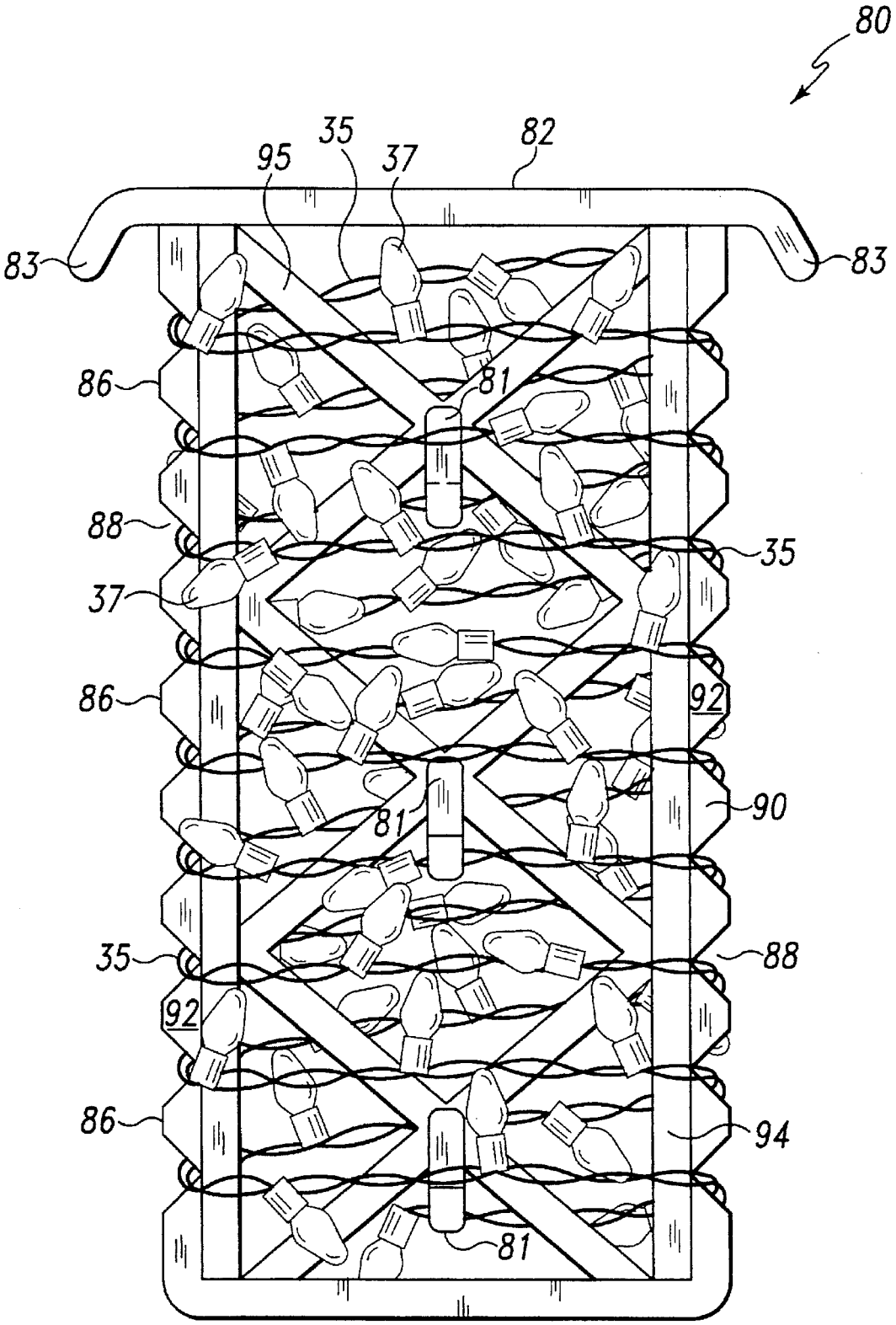
FIG. 2A is a side view of an embodiment of the cordage member of the invention.

Referring to FIG. 2A, cordage member 80 has handle member 82 for grasping by the user. Handle member 82 has opposite terminal ends 83, which are bent obliquely downward relative to the longitudinal axis of handle 82. A pair of downwardly extending strand guides 90 are secured to the handle member 82 between terminal ends 83. Strand guides 90 may be integrally formed with handle member 82, or may be securely fastened to handle member 82. Each of strand guides 90 has an inner surface 94 and an outer surface 92. A plurality of spaced notches 88 for holding cordage are formed in outer surface 92 and extend the length of strand guide 90. Notches 88 can be formed in generally any number and size, and the length of spaces 86, as shown in FIG. 2A, has been exaggerated for purposes of illustration. Strand guides 90 are generally transverse to handle member 82. Support rods 95 are secured at their opposite ends, respectively, to strand guides 90 in order to provide extra strength to cordage member 80. Handle member 82, strand guides 90, and support rods 95 are made from a rigid material, such as wood, metal, plastic, or the like, allowing cordage member 80 to efficiently support several strands of Christmas lights or cordage 35 without bending or breaking. Support rods 95 need not be oriented between strand guides 90 in any particular fashion, but provide the most strength to cordage member 80 when they are secured generally obliquely relative to the strand guides 90, as shown in FIG. 2A. Clamps or fasteners 81 for removably securing cordage to cordage member 80 are, themselves, removably secured to support rods 95 and can be positioned on strand guides or support rods 90,95 as desired.

Figure 2B:
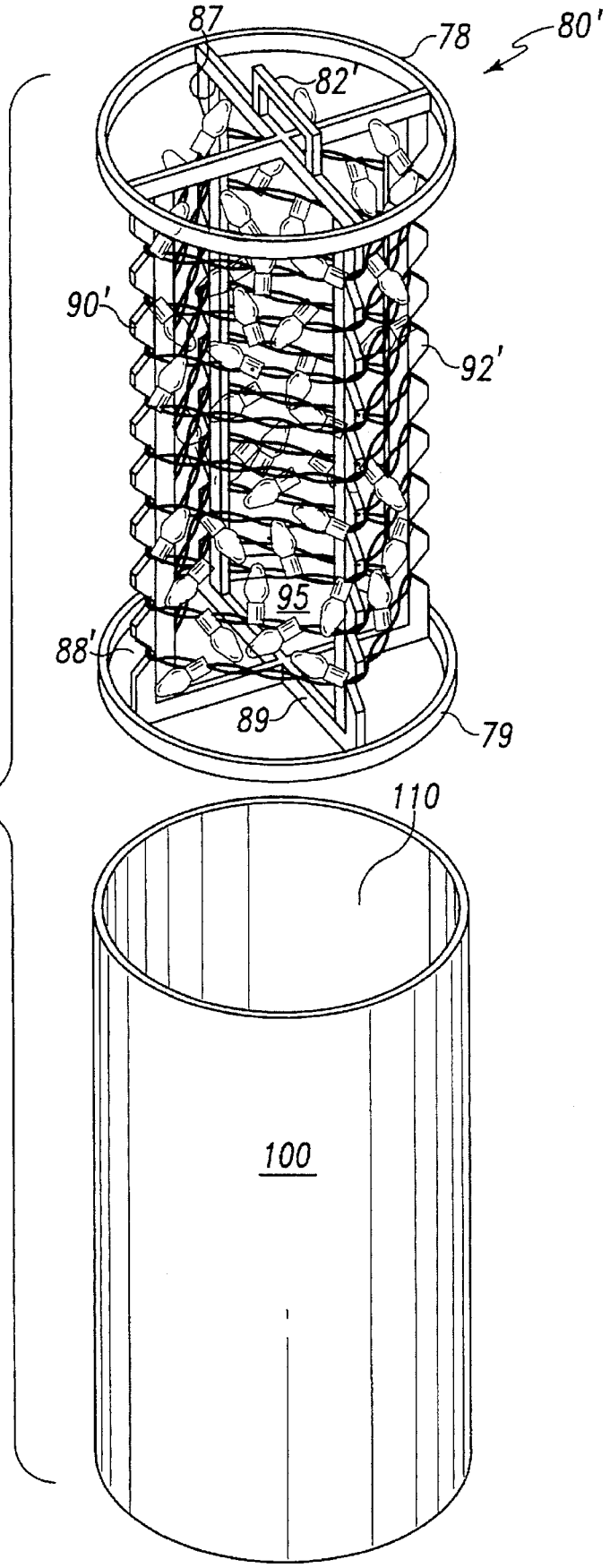
FIG. 2B is a elevated perspective view of an embodiment of the cordage member and cordage member housing of the invention.

In another embodiment, cordage member 80' has a circular top 78 and a circular bottom 79, as shown in FIG. 2B. Common elements in FIGS. 2A and 2B are denoted by similar reference numerals. Top and bottom 78,79 are generally coaxial and are formed from a rigid material, such as wood, metal, plastic, or the like. A handle 82 for the user to grasp is secured to top 78. At least three strand guides 90 extend between top 78 and bottom 79 and are attached at opposite ends 87,89, respectively, to top 78 and bottom 79. Cordage member 80' has a rigid hollow cordage member housing 100 for protecting strands of Christmas lights. Cordage member 80' and cordage member housing 100 are complementarily shaped so that cordage member housing 100 can receive cordage member 80' via open end 110.

Figure 3:
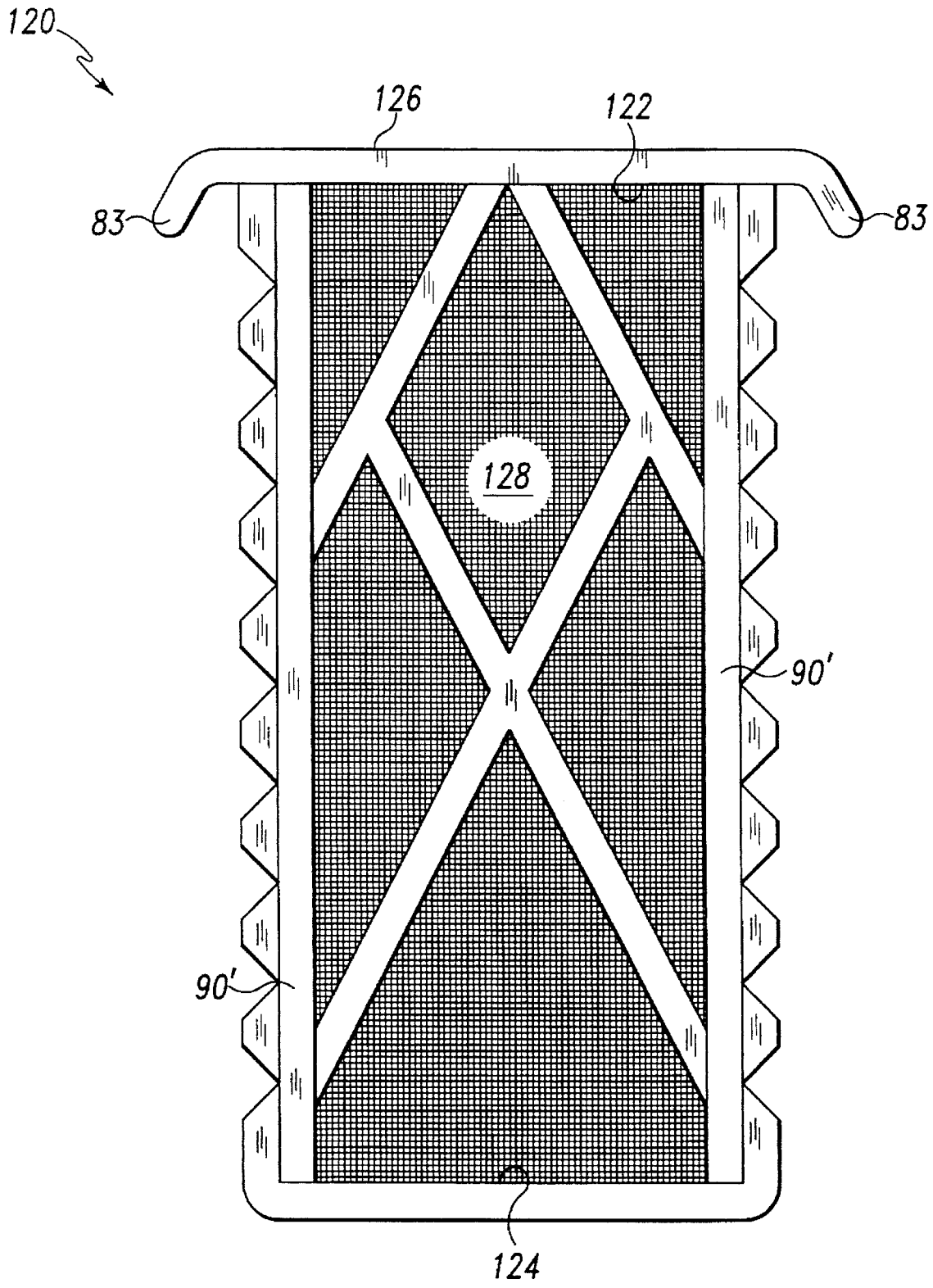
FIG. 3 is a side view of the dividing member of the invention.

Referring to FIG. 3, dividing member 120 is comprised of a handle member 126 for grasping by the user with a downwardly extending dividing body 128 secured .thereto. Dividing member has a top 122 and a bottom 124. In one embodiment, dividing body 128 is formed of a resilient material, such as a mesh weave, flexible membrane, or the like, and is secured to downwardly extending members 90' using technically known means, such as glue, velcro, or the like. Handle member 126 has terminal ends 83, which are bent like those of handle member 82.

In operation, when packaging strands of Christmas lights or cordage 35 and decorating accessories for shipment or storage, top 50 of storage receptacle 10 is opened by way of lock 140 exposing interior 60 as shown in FIG. 1. Cordage member(s) and dividing member(s) 80,120 are extracted from interior. The user grasps handle member 82 or in the case of dividing member 120, handle member 126, and extracts members 80,120 by lifting upward removing terminal ends 83 from slots 33. Strands of Christmas lights or cordage 35 are wrapped around strand guides 90, as shown in FIG. 1.

Preferably in a generally open area so that cordage 35 can be placed on the ground surface without fear of tangling, the user wraps strands of lighting or cordage 35 about strand guides 90. Before cordage 35 is wrapped about the strand guides 90, the terminal end of cordage 35 is secured in place using fasteners 81. This helps ensure that cordage 35 is taunt as the wrapping process begins. Cordage member 80 is held firmly in place by the user grasping handle member 82 with his free hand. As the user wraps cordage 35 about the strand guides 90, notches 88 receive cordage 35 holding it in place. This prevents cordage 35 from sliding free from strand guides 90 and becoming entangled.

After the operator has completely wrapped strands of Christmas lights 35 about strand guides 90, fasteners 81 are used to secure the terminal end of cordage 35. Fasteners 81 securely attach and hold strands of Christmas lights 35 to cordage member 80 preventing them from becoming loose and entangled.

The cordage members 80 are packaged within interior 60 of storage receptacle 10 for shipment or storage. Referring to FIG. 2A, in one embodiment, the user grasps handle member 82 of cordage member 80 and positions cordage member 80 with cordage 35 into receptacle 10. Handle member 82 is oriented such that slots 33 in top edges 32 receive terminal ends 83 of handle member 82. This structure enables cordage member 80 bearing strands of Christmas lights 35 to be securely held in an upstanding spaced position within storage receptacle 10 eliminating tangles and kinks in the cordage. Placement of cordage members 80 into interior 60 may be repeated as desired, or until receptacle 10 has been filled.

Cordage member 80 allows for quick access and identification of an individual strand of lights. A particular color of lights, for example, can quickly be found, since the user can grasp handle member 82 and easily remove and replace cordage member 80 from within receptacle 10 for quick inspection. In addition, the spaced arrangement of the cordage members 80 dictated by the position of spaced slots 33 minimizes bulb breakage, since cordage members 80 supporting the strands of Christmas lights 35 are not able to contact one another.

Referring to FIG. 2B, in the case of the cordage member 80', the wrapping of strands of Christmas lights 35 is done such that the bulbs 37 face inward and are disposed within space 95. This embodiment reduces bulb breakage, since the bulbs 37 are essentially shielded from all contact. In that embodiment, the user grasps handle 82 of cordage member 80' and inserts cordage member 80' into hollow cordage member housing 100 via open end 110. Cordage member 80' and housing 100 may then be securely closed by known means, such as fasteners or lock (not shown). Housing 100 with cordage member 80' therein is positioned within storage receptacle 10 or can be stored separately as desired. Cordage member housing 100 is rigid so that it resists wear and protects strands of Christmas lights or cordage 35 so that the sockets do not become damaged and the bulbs 37 do not break during storage or shipment within receptacle 10.

Dividing member 120, as shown in FIG. 3, enables the user to compartmentalize interior 60 making room for other Christmas decorating accessories like artificial trees, ornaments, or the like, while preventing the strands of Christmas lights 35 and decorations from becoming entangled. Dividing member 120 is positioned within interior 60 in the same fashion as cordage member 80. Handle member 126 of dividing member 120 is oriented such that slots 33 in top edges 32 receive terminal ends 83 of handle member 126. In one embodiment, central dividing body 128 of dividing member 120 is resilient. In that embodiment, dividing body 128 biases the contents against the interior of side and end walls 30,40 such that the contents of the receptacle 10 can be packaged to fit snugly within interior 60. Hinged top 50 is closed and secured in place by known means, such as lock 140 as shown in FIG. 1, so that interior 60 is completely sealed until Christmas time.

Storage receptacle 10 of the invention can be carried or shipped to any location where the strands of Christmas lights 35 will be displayed. The storage receptacle 10 of the invention is capable of storing Christmas lights and accessories together in a neat organized fashion for conveniently locating and easefully accessing the decorations. The receptacle 10, cordage member(s) 80, and housing 100 are formed of a rigid material, which resists wear and deformation.

Cordage member 80 is capable of securely holding, supporting and conveniently handling strands of Christmas lights preventing tangles and kinks in the cordage and shorts in the circuitry. Cordage member(s) 80 can be removed and easily carried outdoors for outside decorating. Finally, dividing member 120 is capable of compartmentalizing the interior of storage receptacle 10 so that the cordage and decorations do not become entangled and accessories can be snugly packaged within receptacle 10 for shipment and storage.

While a specific embodiment of the invention has been shown and described herein for purposes of illustration, the protection afforded by any patent which may issue upon this application is not strictly limited to the disclosed embodiment, but extends to all structures and arrangements which fall fairly within the scope of the claims, which are appended hereto.

What is claimed is:

1. A storage receptacle comprising a bottom, a pair of upstanding side walls, the side walls have top edges with spaced slots formed therein, a pair of oppositely disposed end walls, and a top, wherein each of the walls are joined to the bottom to define an interior and an exterior, at least one cordage member for supporting and securing strands of Christmas lights, the cordage member has a handle member with opposite terminal ends, the terminal ends are bent obliquely downward relative to the longitudinal axis of the cordage member, a pair of downwardly extending strand guides are secured to the handle member between the terminal ends, the cordage member is essentially interchangeable and reversible.

2. The storage receptacle of claim 1 wherein the terminal ends of the handle member are bent obliquely downward relative to the longitudinal axis of the handle member such that the handle member is substantially flush with the top edges.

3. A storage receptacle for Christmas lights and accessories comprising:

a bottom;

a pair of upstanding side walls with top edges;

a pair of oppositely disposed end walls; and, a top, each of the walls are joined to the bottom to define an interior and an exterior, the top edges have spaced slots formed therein;

at least one cordage member for supporting strands of Christmas lights, the cordage member has a handle member with opposite terminal ends, a pair of downwardly extending strand guides are secured to the handle member between the terminal ends, the terminal ends are bent obliquely downward relative to the longitudinal axis of the handle in order that the slots can receive the terminal ends and the cordage member can be removably secured within the interior of the receptacle in an upstanding position;

means for removably securing the strands of Christmas lights to the strand guides;

a plurality of support rods with opposite ends secured, respectively, to the strand guides, each of the strand guides has an outer surface and an inner surface, the outer surfaces face the terminal ends, respectively, and have notches formed therein for supporting strands of Christmas lights;

at least one elongated dividing member for selectively determining the size of the interior as desired, the dividing member has a to, a bottom, and a central dividing body between the top and the bottom, a handle member is fastened to the top of the dividing member, the handle member has opposite terminal ends, the terminal ends of the handle member are shaped in order that the slots in the tops of the side walls can receive the terminal ends.

4. The storage receptacle of claim 3 further comprising a plurality of cordage members and dividing members.

5. The storage receptacle of claim 4 wherein the means for removably securing the strands further comprises fasteners attached to each of the cordage members.

6. The storage receptacle of claim 5 further comprising a means for removably securing the top to the walls to define a closed position.

7. A storage receptacle comprising: a bottom, a pair of upstanding side walls, a pair of oppositely disposed end walls, and, a top, wherein each of the walls are joined to the bottom to define an interior and an exterior, at least one cordage member for supporting and securing strands of Christmas lights, the cordage member further comprises a top, a bottom, and at least three strand guides extending between the top and the bottom, wherein each of the strand guides has an outer surface, an inner surface, and opposite ends, the outer surfaces have notches formed therein, each of the strand guides are secured at their respective opposite ends to the top and the bottom, the top has a handle secured thereto, a hollow cordage member housing with an open end, the cordage member and the housing are complementarily shaped so that the housing can receive the cordage member and, means for securing the cordage member within the housing.

* * * * *